US007485055B1

(12) United States Patent
Lee

(10) Patent No.: US 7,485,055 B1
(45) Date of Patent: Feb. 3, 2009

(54) STRING CLAMPING DEVICE

(76) Inventor: Min-Wei Lee, No. 86-1, Bade Second Road, Renwu Township, Kaohsiung County (TW)

( * ) Notice: Subject to any disclaimer, the term of this patent is extended or adjusted under 35 U.S.C. 154(b) by 0 days.

(21) Appl. No.: 11/892,440

(22) Filed: Aug. 23, 2007

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,249,732 A * 2/1981 Balaban ..... 473/556
5,080,360 A * 1/1992 Longeat ..... 473/556
7,144,342 B1 * 12/2006 Van Der Pols ..... 473/557
7,192,370 B2 * 3/2007 van der Pols ..... 473/557

* cited by examiner

*Primary Examiner*—Raleigh W. Chiu

(57) ABSTRACT

A string clamping device includes a base with two first sidewalls and a movable unit is located between the two first sidewalls and a guide member is connected to an end of the movable unit. A pair of clamping members are pivotably connected between two second sidewalls of the movable unit so as to clamp a string which is guided by the guide member. Each of the two first sidewalls has a first slot and a second slot defined in an inside thereof. The first slots are close to the guide member and inclined to a horizontal plane. Two bearings are connected to the two second sidewalls and movably received in the first and second slots. The movable unit together with the clamping members is pivoted along the inclined first slots when pulling the string such that the string needs not to be bent.

9 Claims, 5 Drawing Sheets

STRING CLAMPING DEVICE

FIELD OF THE INVENTION

The present invention relates to a clamping device for setting proper tensioning to strings of a sport racket and the strings are not bent during tensioning process.

BACKGROUND OF THE INVENTION

Conventional strings for sport rackets are arranged in altitude and longitude directions in the racket head and the strings are pulled to have proper tension such that when the racket hits the ball, the ball flies powerfully and quickly. The strings are pulled by string clamping device while the racket head is securely positioned. The string clamping device is located lower than the racket head so that the racket head does not hit the string clamping device when the racket head rotates in order to string the strings in different directions. However, the lower positioned string clamping device is located lower than the string holes in the racket head pulls the string an angle so that the string is bent at the periphery of the opening of the string hole in the outer side of the racket head. The string might be damaged at the bending point and the periphery of the string holes at the bending point of the string generates a force which may affect the value of tension of the strings.

The present invention intends to provide a string clamping device which pulls the strings straight without any bending points so that the tension of the string is precisely set.

SUMMARY OF THE INVENTION

The present invention relates to a string clamping device that comprises a base and two first sidewalls are located on two sides of the base. A movable unit is located between the two first sidewalls and composed of two second sidewalls. A pair of clamping members are pivotably connected between the two second sidewalls to which a first and second bearings are connected. A guide member is connected to an end of the movable unit. Each of the two first sidewalls has a first slot and a second slot defined in an inside thereof, one end of each of the first slots located close to the guide member is higher than the other end. The first bearings are movably received in the first slots and the second bearings are movably received in the second slots. The movable unit and the clamping members are moved along the first slots when pulling the strings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
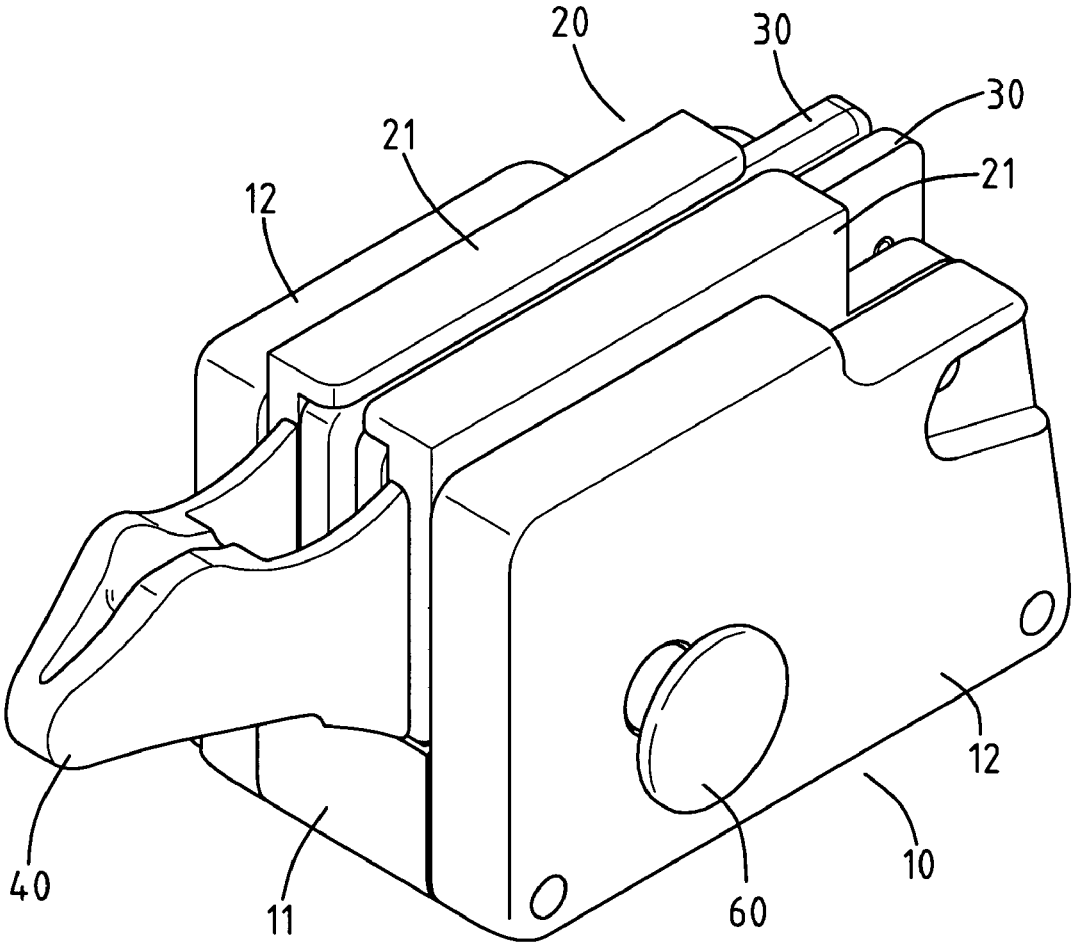
FIG. 1 is a perspective view to show the string clamping device of the present invention.
Figure 2:
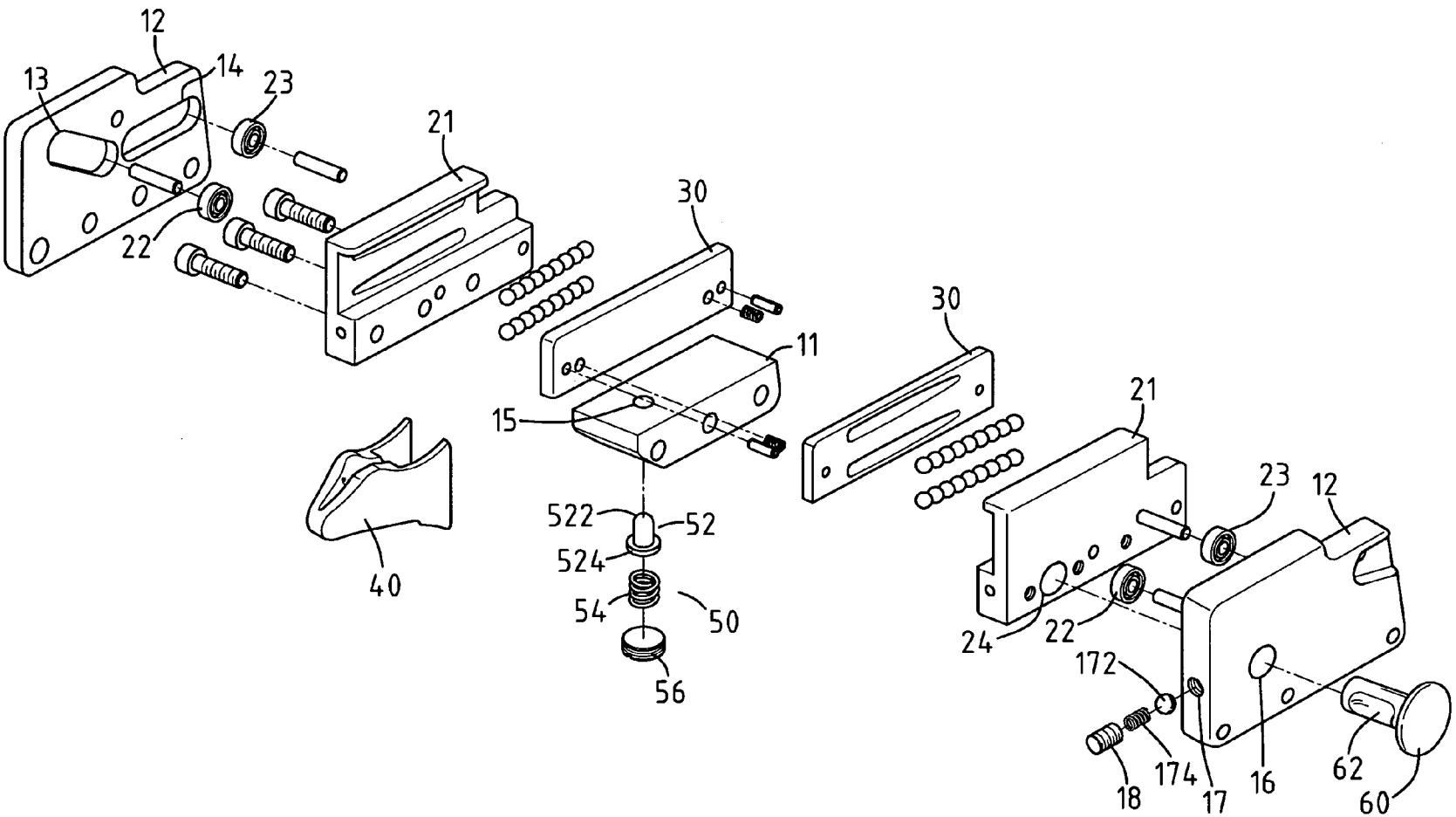
FIG. 2 is an exploded view to show the string clamping device of the present invention.
Figure 3:
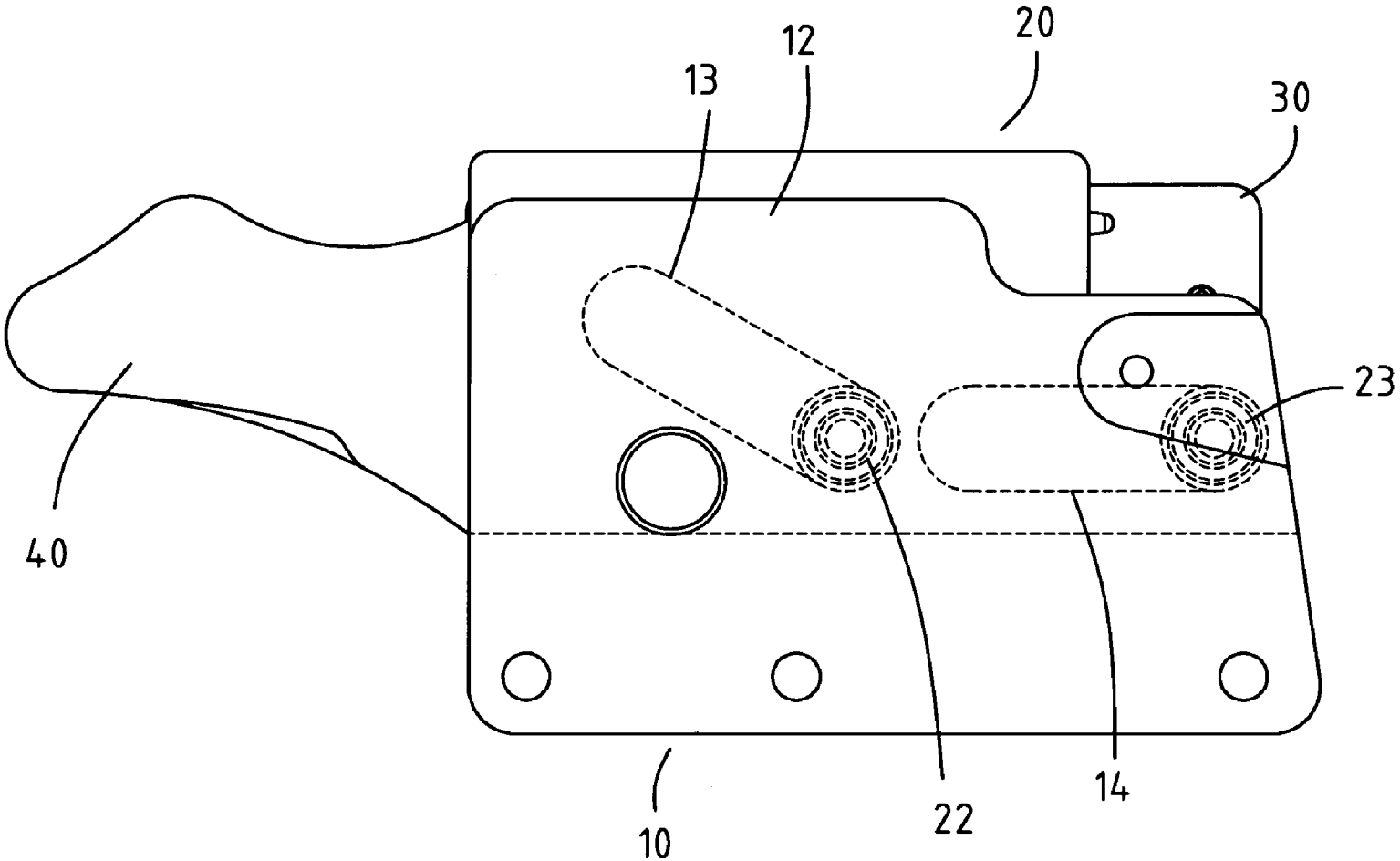
FIG. 3 is a side view to show that the movable unit is not pivoted along the first slots.
Figure 4:
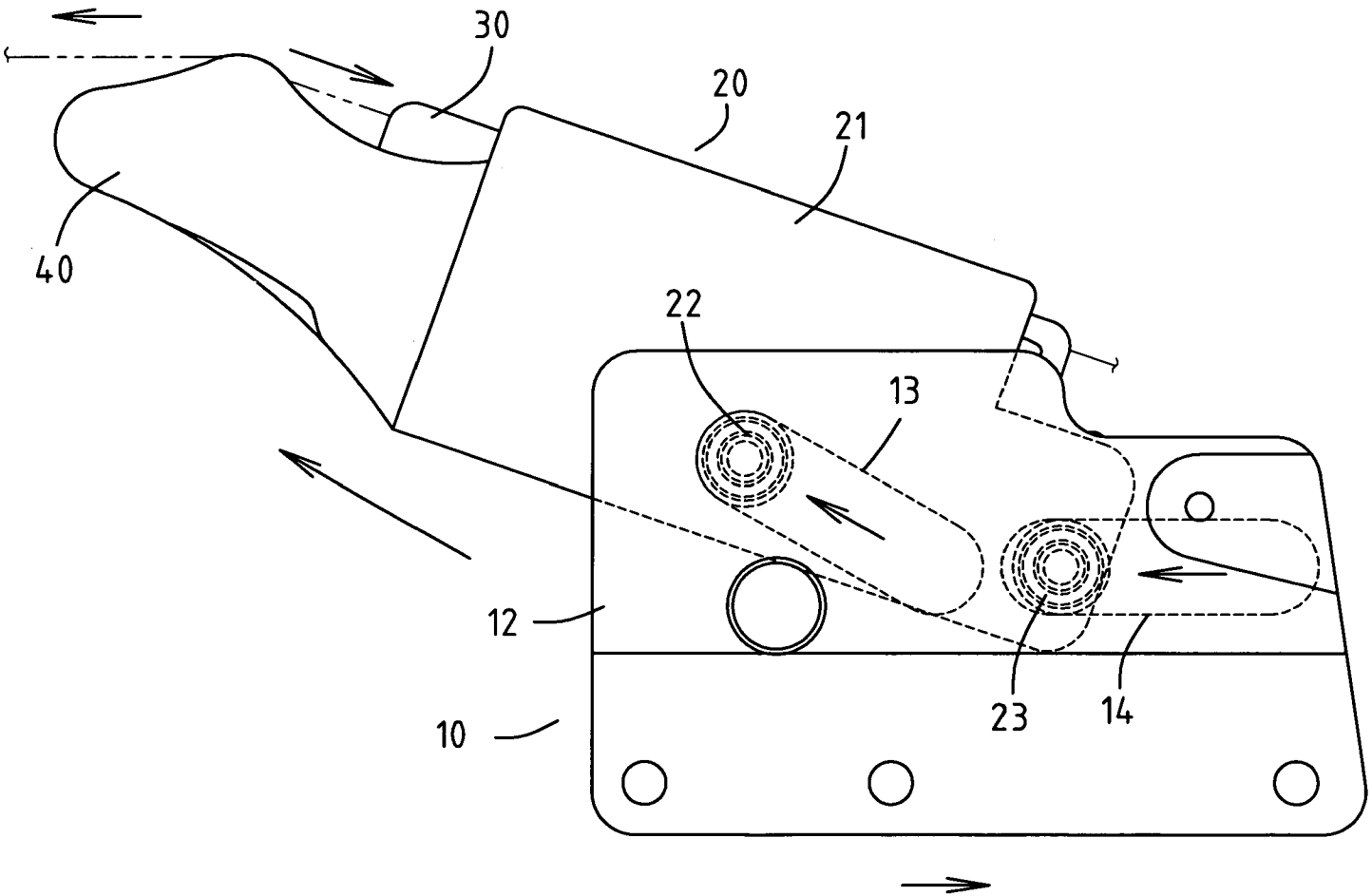
FIG. 4 is a side view to show that the movable unit is pivoted along the first slots.
Figure 5:
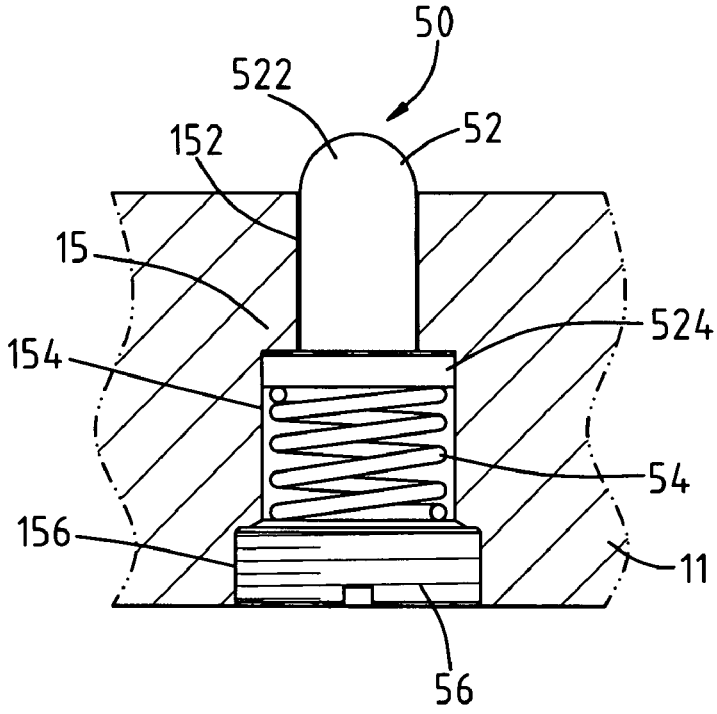
FIG. 5 is a partial cross sectional view to show the shock absorbing unit.

Referring to FIGS. 1 to 4, the string clamping device 10 of the present invention comprises a base 11 and two first sidewalls 12 are located on two sides of the base 11. A movable unit 20 is located between the two first sidewalls 12 and composed of two second sidewalls. A pair of clamping members 30 are pivotably connected between the two second sidewalls 21 and a guide member 40 is connected to an end of the movable unit 20. The clamping members 30 clamp a string as shown in FIG. 4 when pulling the string.

Each of the two second sidewalls 21 has one of two first bearings 22 and one of two second bearings 23 pivotably connected thereto. The two first bearings 22 are located close to the guide member 40. Each of the two first sidewalls 12 has a first slot 13 and a second slot 14 defined in an inside thereof, one end of each of the first slots 13 located close to the guide member 40 is higher than the other end so that each of the first slots 13 is an inclined slot relative to a horizontal plane. Each of the second slots 14 is a horizontal slot. The first bearings 22 are movably received in the first slots 13 and the second bearings 23 are movably received in the second slots 14.

A shock absorbing unit 50 is connected to the base 11 so as to absorb shocks when the movable unit 20 drops on the base 11. The base 11 includes a positioning hole 15 defined therethrough and the shock absorbing unit 50 includes a buffering pin 52 which extends through the positioning hole 15. A first end of the buffering pin 52 is a rounded end and protrudes out from a top of the base 11 and a spring 54 is biased between a second end of the buffering pin 52. An end piece 56 seals the positioning hole 15 in an underside of the base 11 so that the second end of the buffering pin 52 is kept to protrude out from the top of the base 11 by the spring 54.

The positioning hole 15 includes a first space 152, a second space 154 and a threaded space 156, wherein the buffering pin 52 extends through the first space 152, the spring 54 is located in the second space 154 and the end piece 56 is threadedly connected with the threaded section 156. An inner diameter of the first space 152 is smaller than an inner diameter of the second space 154, a flange 524 extends radially outward from the second end of the buffering pin 52 and is stopped by a shoulder portion between the first and second spaces 152, 154.

As shown in FIG. 3, when the clamping members 30 do not clamp the string, the first and second bearings 22, 23 are located at the lower end of the first slots 13 and the right end of the second slots 14.

As shown in FIG. 4, when the clamping members 30 clamp the string and pulls the string, the movable unit 20 together with the clamping members 30 are pivoted along the first slots 13. Because the movable unit 20 and the guide member 40 are pivoted upward and the string is in align with the string hole of the racket head (both not shown), so that the string is straightened and needs not to be bent at the periphery of the string hole.

After the string is held and positioned, the clamping members 30 release the string and drop along the first slots 13 due to gravity, the movable unit 20 hits the rounded end 522 of the buffering pin 52 which compresses the spring 54 to absorb the energy so as to protect the movable unit 20 and the base 11.

Figure 6:
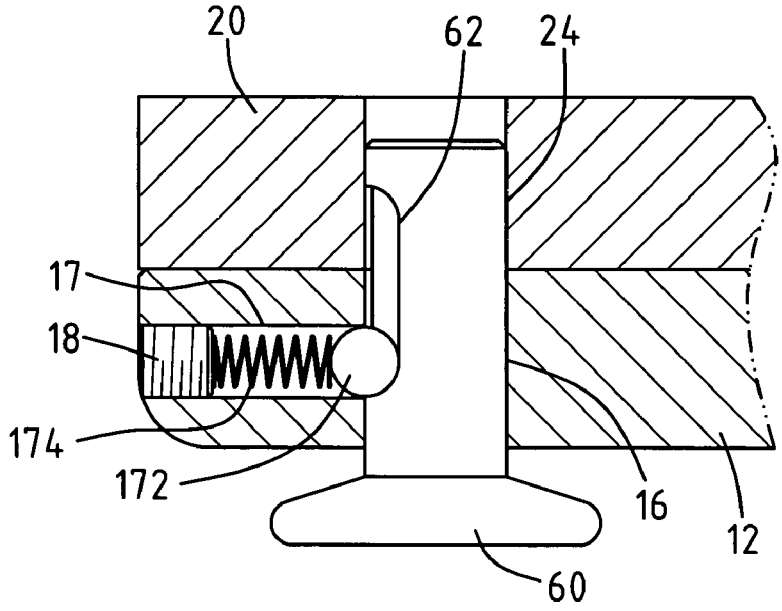
FIG. 6 is a partial cross sectional view to show that the positioning pin extends through the first and second sidewalls of the string clamping device of the present invention.

As shown in FIG. 6, a positioning pin 60 extends through a transverse hole 16 defined through one of the two first sidewalls 12 and is removably engaged with a through hole 24 defined in the second sidewall 21. The positioning pin 60 includes an axial groove 62 defined in a shank thereof. A recess 17 is defined in an end of the first sidewall 12 and communicates with the transverse hole 16. A bead 172 and a spring 174 are received in the recess 17 and a nut 18 seals the recess 17. The bead 172 is biased by the spring 174 and movably engaged with the axial groove 62 of the positioning pin 60. By this arrangement, when the positioning pin 60 is located as shown in FIG. 6, the movable unit 20 cannot be pivoted along the first slots 13. This is helpful when installing the main strings to the racket head and the guide member 40 does not hit the handle of the racket.

While we have shown and described the embodiment in accordance with the present invention, it should be clear to those skilled in the art that further embodiments may be made without departing from the scope of the present invention.

What is claimed is:

1. A string clamping device comprising:

a base and two first sidewalls which are located on two sides of the base;

a movable unit located between the two first sidewalls and composed of two second sidewalls;

a pair of clamping members pivotably connected between the two second sidewalls;

a guide member connected to an end of the movable unit;

each of the two second sidewalls having one of two first bearings and one of two second bearings pivotably connected thereto, the two first bearings located close to the guide member, each of the two first sidewalls having a first slot and a second slot defined in an inside thereof, one end of each of the first slots located close to the guide member being higher than the other end, the first bearings movably received in the first slots and the second bearings movably received in the second slots, the movable unit being moved along the first slots.

2. The device as claimed in claim 1, wherein a shock absorbing unit is connected to the base so as to absorb shocks when the movable unit drops on the base.

3. The device as claimed in claim 2, wherein the base includes a positioning hole defined therethrough and the shock absorbing unit includes a buffering pin which extends through the positioning hole, a first end of the buffering pin protrudes out from a top of the base and a spring is biased between a second end of the buffering pin and an end piece which seals the positioning hole in an underside of the base, the positioning hole includes a first space, a second space and a threaded space, the buffering pin extends through the first space, the spring located in the second space and the end piece is threadedly connected with the threaded section.

4. The device as claimed in claim 3, wherein the first end of the buffering pin is a rounded end.

5. The device as claimed in claim 3, wherein an inner diameter of the first space is smaller than an inner diameter of the second space, a flange extends radially outward from the second end of the buffering pin and is stopped by a shoulder portion between the first and second spaces.

6. The device as claimed in claim 1, wherein a positioning pin extends through one of the two first sidewalls and is removably inserted in one of the second sidewalls.

7. The device as claimed in claim 6, wherein the positioning pin extends through a transverse hole defined through the first sidewall and is removably inserted into a through hole defined in the second sidewall.

8. The device as claimed in claim 7, wherein the positioning pin includes an axial groove defined in a shank thereof and a recess is defined in an end of the first sidewall, the recess communicates with the transverse hole, a bead and a spring are received in the recess and a nut seals the recess, the bead is biased by the spring and movably engaged with the axial groove of the positioning pin.

9. The device as claimed in claim 1, wherein each of the second slots is a horizontal slot.

* * * * *